US008342155B2

(12) United States Patent
Fujino et al.

(10) Patent No.: US 8,342,155 B2
(45) **Date of Patent: *Jan. 1, 2013**

(54) INJECTOR

(75) Inventors: Tomoki Fujino, Okazaki (JP); Jun Kondo, Nagoya (JP); Shu Kagami, Nagoya (JP)

(73) Assignee: Denso Corporation, Kariya (JP)

( * ) Notice: Subject to any disclaimer, the term of this patent is extended or adjusted under 35 U.S.C. 154(b) by 447 days.

This patent is subject to a terminal disclaimer.

(21) Appl. No.: 12/753,360

(22) Filed: Apr. 2, 2010

(65) Prior Publication Data

US 2010/0252003 A1 Oct. 7, 2010

(30) Foreign Application Priority Data

Apr. 3, 2009 (JP) ..... 2009-90761

(51) Int. Cl.
*F02M 51/00* (2006.01)

(52) U.S. Cl. ..... 123/472; 123/490

(58) Field of Classification Search ..... 123/490, 123/472, 445

See application file for complete search history.

(56) References Cited

U.S. PATENT DOCUMENTS

2008/0228374 A1 9/2008 Ishizuka et al.
2010/0251997 A1* 10/2010 Fujino et al. ..... 123/445
2010/0252001 A1* 10/2010 Morita et al. ..... 123/472
2010/0252650 A1* 10/2010 Kagami et al. ..... 239/101
2010/0252651 A1* 10/2010 Kagami et al. ..... 239/106
2010/0252659 A1* 10/2010 Fujino et al. ..... 239/585.5
2010/0263629 A1* 10/2010 Kondo et al. ..... 123/445
2010/0264236 A1* 10/2010 Fujino et al. ..... 239/289
2010/0264239 A1* 10/2010 Kondo et al. ..... 239/533.3

FOREIGN PATENT DOCUMENTS

JP 2007-278139 10/2007

* cited by examiner

*Primary Examiner* — John Kwon

(74) *Attorney, Agent, or Firm* — Nixon & Vanderhye PC

(57) ABSTRACT

An injector has a body that defines a high-pressure passage for passing high-pressure fuel to an injection hole inside, a needle that is accommodated in the body and that opens and closes the injection hole, an electric actuator that causes the needle to perform the opening and closing action, a lead wire that is arranged in a lead wire insertion hole formed in the body and that supplies an electric power to the electric actuator, and a fuel pressure sensor that is fixed to the body and that senses pressure of the high-pressure fuel. An outlet hole, via which the lead wire extends from the lead wire insertion hole to an outside of the body, is located at a position closer to the injection hole than the fuel pressure sensor is.

14 Claims, 6 Drawing Sheets

COMPARATIVE EXAMPLE

COMPARATIVE EXAMPLE

COMPARATIVE EXAMPLE

COMPARATIVE EXAMPLE

COMPARATIVE EXAMPLE

COMPARATIVE EXAMPLE

COMPARATIVE EXAMPLE

COMPARATIVE EXAMPLE

INJECTOR

CROSS REFERENCE TO RELATED APPLICATION

This application is based on and incorporates herein by reference Japanese Patent Application No, 2009-90761 filed on Apr. 3, 2009.

BACKGROUND OF THE INVENTION

1. Field of the Invention

The present invention relates to an injector that is mounted to an internal combustion engine and that injects fuel from an injection hole, the fuel being used for combustion.

2. Description of Related Art

Generally, a conventional injector is constructed by accommodating a needle for opening and closing an injection hole, an electric actuator for causing the needle to perform the opening-closing action and the like in a body, in which a high-pressure passage for passing high-pressure fuel to the injection hole is formed. Generally, a lead wire for supplying electricity to the electric actuator is arranged in a lead wire insertion hole formed in the body, and an outlet hole, via which the lead wire extends from the insertion hole to an outside of the body, is formed in an end face of the body opposite from the injection hole side (refer to Patent document 1: JP-A-2007-278139).

For accurate control of output torque and an emission state of the internal combustion engine, it is important to accurately control an injection state of fuel injected from the injector such as injection start timing and an injection quantity of the fuel. Therefore, a technology described in Patent document 2 (JP-A-2008-144749) mounts a fuel pressure sensor to a body and senses fuel pressure, which fluctuates in connection with injection, thereby sensing an actual injection state. For example, actual injection start timing is sensed by sensing timing when the fuel pressure starts decreasing in connection with an injection start, and an actual injection quantity is sensed by sensing the magnitude of the decrease of the fuel pressure.

However, Patent document 2 does not describe details of a mounting structure of the fuel pressure sensor. The inventors of the present invention examined a structure for mounting a fuel pressure sensor 50*x* to a body 4*x* described in Patent document 1 as shown in FIGS. 4A to 4D and FIGS. 6A to 6D.

In this case, an outlet hole 47*cx* is formed in an end face of the body 4*x* on a side opposite from an injection hole. Therefore, in order to prevent interference between a lead wire insertion hole 47*cx* extending toward the outlet hole 47*cx* and the fuel pressure sensor 50*x*, a mounting space of the fuel pressure sensor 50*x* is restrained. Or, in order to prevent the interference, it is required to enlarge the size of the body 4*x* and to newly provide the mounting space of the fuel pressure sensor 50*x*.

SUMMARY OF THE INVENTION

It is an object of the present invention to provide an injector that has a fuel pressure sensor fixed to a body and that improves a mounting freedom degree of the fuel pressure sensor while suppressing increase in a body size.

According to a first example aspect of the present invention, an injector has a body that defines a high-pressure passage for passing high-pressure fuel to an injection hole inside, a needle that is accommodated in the body and that opens and closes the injection hole, an electric actuator that causes the needle to perform the opening and closing action, a lead wire that is arranged in a lead wire insertion hole formed in the body and that supplies an electric power to the electric actuator, and a fuel pressure sensor that is fixed to the body and that senses pressure of the high-pressure fuel. The body is formed with an outlet hole, through which the lead wire extends from the lead wire insertion hole to an outside of the body. The outlet hole is located at a position closer to the injection hole than the fuel pressure sensor is (hereafter, position closer to injection hole will be referred to as lower position).

According to the above-described aspect, the outlet hole, through which the lead wire extends to the outside, is located below the fuel pressure sensor. Therefore, the lead wire insertion hole extending toward the outlet hole is located below the mounting space of the fuel pressure sensor. Therefore, the lead wire insertion hole and the fuel pressure sensor can be prevented from abutting each other in the radial direction of the body. Accordingly, a degree of freedom of mounting of the fuel pressure sensor can be improved while inhibiting increase of the size of the body.

According to a second example aspect of the present invention, an injector has a body that defines a high-pressure passage for passing high-pressure fuel to an injection hole inside, a needle that is accommodated in the body and that opens and closes the injection hole, an electric actuator that causes the needle to perform the opening and closing action, a lead wire that is arranged in a lead wire insertion hole formed in the body and that supplies an electric power to the electric actuator, and a fuel pressure sensor that is fixed to the body and that senses pressure of the high-pressure fuel. The body is formed in the shape of a substantially cylindrical column such that the injection hole is formed in a tip end of the body. The body is formed with an outlet hole, through which the lead wire extends from the lead wire insertion hole to an outside of the body. The outlet hole is formed in an outer peripheral surface of the body. The lead wire insertion hole has a first insertion hole that extends along a direction of a central axis of the substantially cylindrical column shape of the body and a second insertion hole that extends from an end portion of the first insertion hole toward the outlet hole. The end portion of the first insertion hole is located at a position closer to the injection hole than the fuel pressure sensor is (i.e., position lower than fuel pressure sensor).

According to the above-described aspect, the end portion of the first insertion hole is located below the fuel pressure sensor. Therefore, the first lead wire insertion hole extending along the direction of the central axis of the cylindrical column and the fuel pressure sensor can be prevented from abutting each other in the radial direction of the body. Accordingly, a degree of freedom of mounting of the fuel pressure sensor can be improved while inhibiting increase of the size of the body.

According to a third example aspect of the present invention, a high-pressure port, to which the high-pressure fuel is supplied, and a low-pressure port, from which surplus fuel is discharged, are formed in an outer peripheral surface of the substantially cylindrical column shape of the body. A sensor fixation section is provided in an end portion of the substantially cylindrical column shape of the body such that the sensor fixation section protrudes further than the high-pressure port and the low-pressure port toward a side opposite from the injection hole (hereafter, position further from injection hole will be referred to as upper position). The fuel pressure sensor is fixed to the sensor fixation section and the outlet hole is formed in the sensor fixation section. A portion of the lead wire arranged outside the outlet hole and the fuel pressure sensor are molded and sealed together with the sensor fixation section by using a resin.

According to the above-described aspect, the portion of the lead wire arranged outside the outlet hole and the fuel pressure sensor are molded together with the sensor fixation section using the resin. Therefore, the portion of the lead wire arranged outside the outlet hole and the fuel pressure sensor can be easily fixed to the body (sensor fixation section) in an insulated state, which is preferable.

Moreover, a portion of the body to be molded with the resin (i.e., sensor fixation section) is formed in the shape protruding upward further than the high-pressure port and the low-pressure port. Therefore, the size of the resin mold can be reduced as compared to the case where also portions of the both ports are molded with the resin. Eventually, the construction can contribute to the reduction of the body size of the injector.

Since the sensor fixation section is formed in the shape protruding upward, the space for arranging the fuel pressure sensor and the outlet hole becomes a limited and small space. Therefore, the above-described effect of improving the degree of freedom of the mounting of the fuel pressure sensor while inhibiting the increase in the size of the body can be exerted suitably.

According to a fourth example aspect of the present invention, the body is inserted and arranged in a body insertion hole formed in a cylinder head of the internal combustion engine and is pressed against the body insertion hole by a clamp. The body has a pressed surface, which the clamp contacts to press the body. The sensor fixation section is located on a side of the pressed surface opposite from the injection hole (i.e., above pressed surface).

According to the above-described aspect, the fuel pressure sensor is arranged above the pressed surface of the body, to which the force is applied from the clamp. Therefore, the fuel pressure sensor is located in a position distanced from a portion of the body where a large strain is caused (i.e., portion between portion held by cylinder head and pressed surface). Accordingly, an influence of the strain caused in the body on the fuel pressure sensor can be suppressed, thereby improving the sensing accuracy of the fuel pressure.

According to a fifth example aspect of the present invention, the body is inserted and arranged in a body insertion hole formed in a cylinder head of the internal combustion engine and is pressed against the body insertion hole by a clamp. The body has a pressed surface, which the clamp contacts to press the body. A sensor fixation section is provided in an end portion of the body on a side opposite from the injection hole such that the sensor fixation section protrudes further than the pressed surface toward the side opposite from the injection hole (i.e., toward upper side). The fuel pressure sensor is fixed to the sensor fixation section.

According to the above-described aspect, the fuel pressure sensor is arranged above the pressed surface. Accordingly, like the above-described fourth example aspect of the present invention, an influence of the strain caused in the body on the fuel pressure sensor can be suppressed, thereby improving the sensing accuracy of the fuel pressure.

Since the sensor fixation section is formed in the shape protruding on the upper side of the pressed surface, arrangement of the fuel pressure sensor above the pressed surface can be realized with a simple construction while the space for arranging the fuel pressure sensor becomes a limited and small space. Therefore, the above-described effect of improving the degree of freedom of mounting of the fuel pressure sensor while inhibiting the increase in the size of the body can be exerted suitably.

According to a sixth example aspect of the present invention, the fuel pressure sensor has a strain element, which is fixed to the body and which elastically deforms in response to pressure of the high-pressure fuel, and a sensor element, which is fixed to the strain element and which converts magnitude of strain caused in the strain element into an electrical signal. The sensor fixation section is formed in the shape of a substantially cylindrical column and is formed with a depressed portion depressed from an outer peripheral surface or an end face of the substantially cylindrical column shape of the sensor fixation section. The strain element is inserted and arranged in the depressed portion.

According to the above-described aspect, the depressed portion for inserting and arranging the strain element is formed to be depressed from the outer peripheral surface or the end face of the cylindrical column shape of the sensor fixation section. Therefore, increase of the size of the sensor fixation section can be inhibited. Since the fuel pressure sensor is fixed to the depressed portion depressed from the sensor fixation section in this way, the space for arranging the fuel pressure sensor is the limited and small space. Therefore, the above-described effect of improving the degree of freedom of the mounting of the fuel pressure sensor while inhibiting the increase in the size of the body can be exerted suitably.

According to a seventh example aspect of the present invention, the injector further has a connector housing that is fixed to the body and that is connected with an external harness through a connector, a sensor connector terminal that is electrically connected with the fuel pressure sensor, and a drive connector terminal that is electrically connected with the lead wire. The connector housing holds the sensor connector terminal and the drive connector terminal to provide the sensor connector terminal and the drive connector terminal in the common connector.

That is, the sensor connector terminal and the drive connector terminal are held by the common connector housing to constitute the single connector with the connector housing and the both terminals. Therefore, the fuel pressure sensor can be mounted in the injector without increasing the number of the connectors. The harnesses connecting the external devices such the an engine ECU with the connector extend collectively from the single connector provided in the injector. Therefore, management of the harnesses can be simplified. Thus, increase in work for connecting the connector can be avoided.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENT

Figure 1:
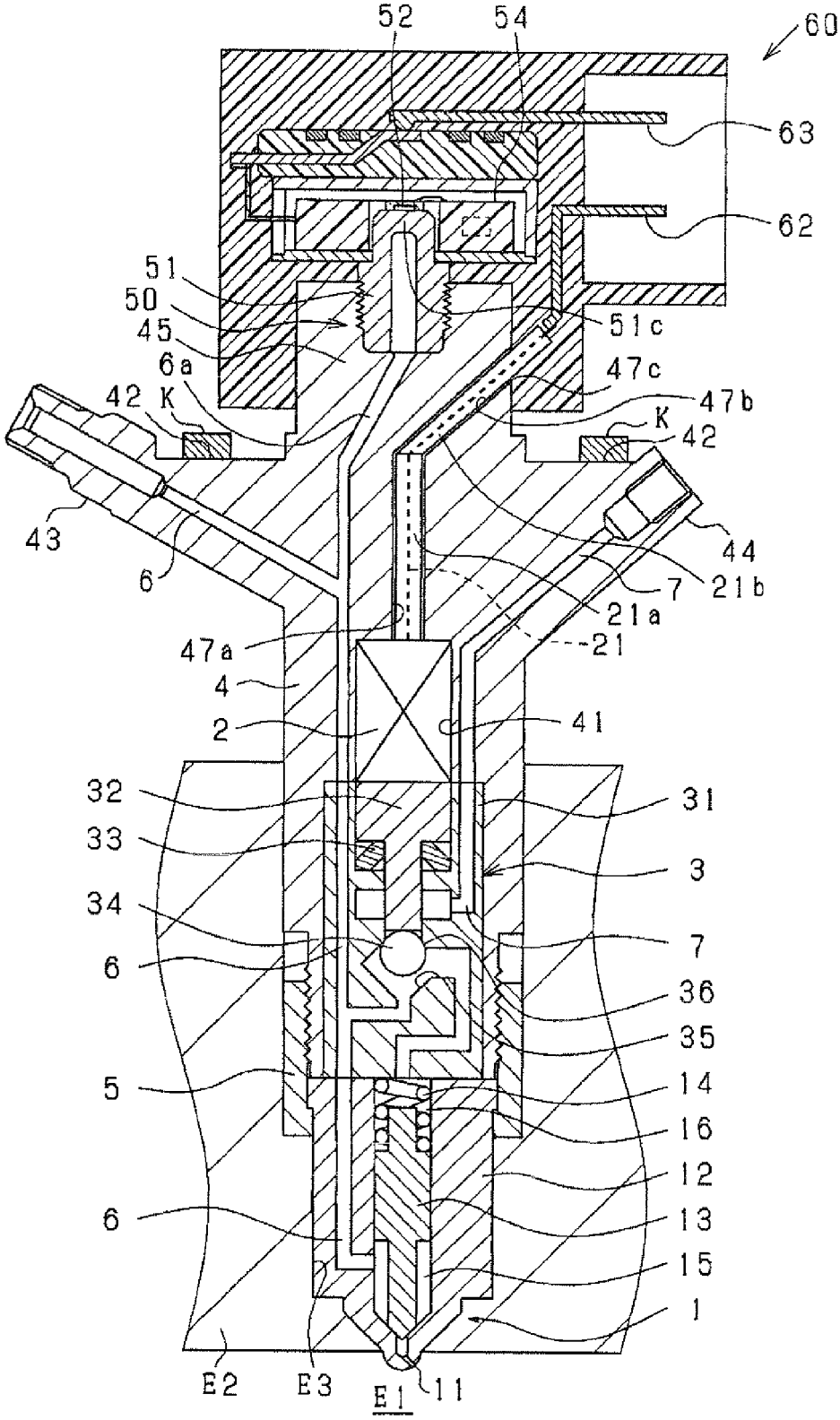
FIG. 1 is a longitudinal cross-sectional view showing an injector according to a first embodiment of the present invention.

Hereafter, embodiments of the present invention will be described with reference to the drawings. In the following description of the respective embodiments, the same sign is used in the drawings for identical or equivalent parts.

First Embodiment

Now, a first embodiment of the present invention will be described with reference to FIGS. 1 to 3D. FIG. 1 is a schematic longitudinal cross-sectional view showing a general internal construction of an injector (fuel injection valve) according to the present embodiment. First, a basic construction and action of the injector will be explained with reference to FIG. 1.

The injector injects high-pressure fuel stored in a common rail (pressure accumulation vessel, not shown) into a combustion chamber E1 formed inside a cylinder of a diesel internal combustion engine. The injector has a nozzle 1 that injects the fuel when the nozzle 1 opens, an electric actuator 2 that drives when electricity is supplied thereto, and a back pressure control mechanism 3 that is driven by the electric actuator 2 and that controls back pressure of the nozzle 1.

The nozzle 1 has a nozzle body 12 formed with an injection hole 11, a needle 13 that is seated on and separated from a valve seat of the nozzle body 12 to close and open the injection hole 11, and a spring 14 that biases the needle 13 in a valve-closing direction.

The electric actuator 2 according to the present embodiment is a piezo actuator constituted by a laminated body (piezo stack) formed by stacking multiplicity of piezoelectric elements. The electric actuator 2 is switched between an extended state and a contracted state by switching charge and discharge of the piezoelectric elements. Thus, the piezo stack functions as an actuator that operates the needle 13. Alternatively, an electromagnetic actuator constituted by a stator and an armature may be used in place of the piezo actuator.

A valve body 31 of the back pressure control mechanism 3 accommodates a piston 32 that moves to follow the extension and the contraction of the piezo actuator 2, a disc spring 33 that biases the piston 32 toward the piezo actuator 2 side, and a spherical valve member 34 that is driven by the piston 32.

An injector body 4 is formed substantially in the shape of a cylinder. An accommodation hole 41 in the shape of a cylindrical column having a step is formed in a radially central portion of the injector body 4 such that the accommodation hole 41 extends in an axial direction of the injector (vertical direction in FIG. 1). The piezo actuator 2 and the back pressure control mechanism 3 are accommodated in the accommodation hole 41. A retainer 5 substantially in the shape of a cylinder is screwed to the injector body 4, whereby the nozzle 1 is held at an end portion of the injector body 4.

A high-pressure passage 6 and a low-pressure passage 7 are formed in the nozzle body 12, the injector body 4 and the valve body 31. High-pressure fuel is invariably supplied from the common rail to the high-pressure passage 6. The low-pressure passage 7 is connected to a fuel tank (not shown). The bodies 12, 4, 31 are made of metal. Strength of the bodies 12, 4, 31 is heightened by performing quenching treatment. Further, hardness of surfaces of the bodies 12, 4, 31 is heightened by performing carburizing treatment.

The bodies 12, 4, 31 are inserted and arranged in a body insertion hole E3 formed in a cylinder head E2 of the internal combustion engine. An engagement portion 42 (pressed surface) that engages with an end of a clamp K is formed in the injector body 4. If the other end of the clamp K is tightened by a bolt to the cylinder head E2, the end of the clamp K presses the engagement portion 42 toward the body insertion hole E3. Thus, the injector is fixed in a state where the injector is pressed into the body insertion hole E3.

A high-pressure chamber 15 constituting a part of the high-pressure passage 6 is formed between an outer peripheral surface of the needle 13 on the injection hole 11 side and an inner peripheral surface of the nozzle body 12. The high-pressure chamber 15 communicates with the injection hole 11 when the needle 13 is displaced in a valve-opening direction. A back pressure chamber 16 is formed on a side of the needle 13 opposite from the injection hole side. The side opposite from the injection hole side will be referred to as an upside, hereafter. The spring 14 is arranged in the back pressure chamber 16.

The valve body 31 is formed with a high-pressure seat surface 35 in a route connecting the high-pressure passage 6 in the valve body 31 and the back pressure chamber 16 of the nozzle 1. The valve body 31 is formed with a low-pressure seat surface 36 in a route connecting the low-pressure passage 7 in the valve body 31 and the back pressure chamber 16 of the nozzle 1. The valve member 34 is arranged between the high-pressure seat surface 35 and the low-pressure seat surface 36.

A high-pressure port 43 (high-pressure pipe connection) and a low-pressure port 44 (low-pressure pipe connection) are formed in an outer peripheral surface of the injector body 4, which is substantially in the shape of the cylindrical column. The high-pressure port 43 is connected with a high-pressure pipe (not shown). The low-pressure port 44 is connected with a low-pressure pipe (not shown). The fuel supplied from the common rail to the high-pressure port 43 via the high-pressure pipe is supplied from the outer peripheral surface side of the cylindrical injector body 4. The fuel supplied to the injector flows into the high-pressure chamber 15 and the back pressure chamber 16 through the high-pressure passage 6.

The high-pressure passage 6 has a branch passage 6*a* that branches to the upper portion of the injector body 4. The fuel in the high-pressure passage 6 is introduced into a fuel pressure sensor 50 (explained later) through the branch passage 6*a*.

A connector 60 is fixed to the upper portion of the injector body 4. The electric power supplied from an exterior to a terminal of the connector 60 (drive connector terminal 62) is supplied to the piezo actuator 2 through a lead wire 21. Thus, the piezo actuator 2 extends. If the electric power supply is stopped, the piezo actuator 2 contracts.

When the piezo actuator 2 is in the contracted state in the above-described construction, the valve member 34 contacts the low-pressure seat surface 36 and the back pressure chamber 16 is connected with the high-pressure passage 6, whereby the high fuel pressure is introduced into the back pressure chamber 16. The fuel pressure and the spring 14 in the back pressure chamber 16 bias the needle 13 in the valve-closing direction, whereby the injection hole 11 is closed.

When a voltage is applied to the piezo actuator 2 and the piezo actuator 2 is brought to the extended state, the valve member 34 contacts the high-pressure seat surface 35 and the back pressure chamber 16 is connected with the low-pressure passage 7, whereby the back pressure chamber 16 is depressurized. The fuel pressure in the high-pressure chamber 15 biases the needle 13 in the valve-opening direction, whereby the injection hole 11 is opened. The fuel is injected from the injection hole 11 into the combustion chamber E1.

The pressure of the high-pressure fuel in the high-pressure passage 6 fluctuates in connection with the fuel injection from the injection hole 11. The fuel pressure sensor 50 for sensing the pressure fluctuation is fixed to the injector body 4. Actual injection start timing can be sensed by sensing timing when the fuel pressure starts decreasing in connection with the injection start from the injection hole 11 in a pressure fluctuation waveform sensed by the fuel pressure sensor 50. Actual injection end timing can be sensed by sensing timing when the fuel pressure starts increasing in connection with an injection end. An injection quantity can be sensed by sensing the maximum fuel pressure decrease amount caused in connection with the injection in addition to the injection start timing and the injection end timing.

Figure 2:
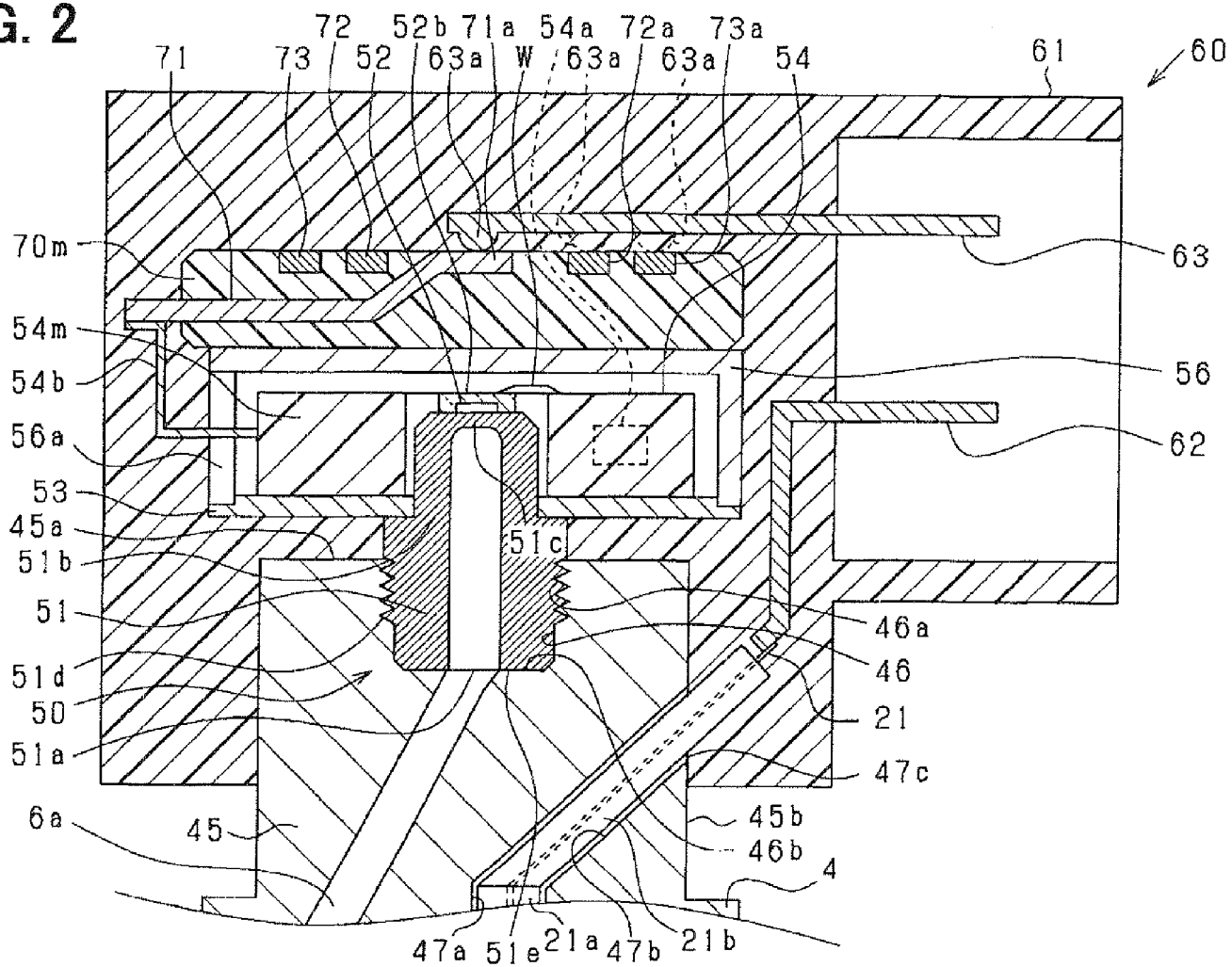
FIG. 2 is an enlarged longitudinal cross-sectional view showing a structure for mounting a fuel pressure sensor to the injector according to the first embodiment.

Next, a structure of a single body of the fuel pressure sensor 50 and a mounting structure for mounting the fuel pressure sensor 50 to the injector body 4 will be explained with reference to FIG. 2.

The fuel pressure sensor 50 has a stem 51 (strain element) and a strain gage 52 (sensor element). The stem 51 elastically deforms when the pressure of the high-pressure fuel in the branch passage 6*a* is applied to the stem 51. The strain gage 52 converts the magnitude of the strain caused in the stem 51 into an electrical signal and outputs the electrical signal as a pressure sensing value.

The stem 51 has a cylinder section 51*b* in the shape of a cylinder and a diaphragm section 51*c* in the shape of a disc. An inlet hole 51*a* for introducing the high-pressure fuel to an inside of the cylinder section 51*b* is formed in an end of the cylinder section 51*b*. The diaphragm section 51*c* blocks the other end of the cylinder section 51*b*. An inner surface of the cylinder section 51*b* and the diaphragm section 51*c* receive the pressure of the high-pressure fuel flowing into the cylinder section 51*b* through the inlet hole 51*a*. Thus, the entire body of the stem 51 elastically deforms.

The stem 51 is made of metal. The metal material of the stem 51 is required to have high strength and high hardness since the stem 51 receives extra-high pressure. In addition, it is required that the metal material causes little deformation due to thermal expansion and causes little influence on the strain gage 52. That is, the metal material is required to have a low thermal expansion coefficient. For example, iron (Fe), nickel (Ni) and cobalt (Co) may be used as the metal material. Alternatively, a material that contains the iron and the nickel as main components and that contains titanium (Ti), niobium (Ni) and aluminum (Al) or a material containing the titanium and the niobium as a precipitation strengthening material may be used as the metal material. The stem 51 can be formed by applying press work, cutting work, cold forging or the like to the metal material. Alternatively, a material containing carbon (C), silicon (Si), manganese (Mn), phosphorus (P), sulfur (S) and the like may be used.

A sensor fixation section 45 is provided in a cylindrical column end portion of the injector body 4, which is formed substantially in the shape of the cylindrical column. The sensor fixation section 45 is formed in the shape of a cylindrical column protruding upward from the fixation positions of the high-pressure port 43 and the low-pressure port 44. A depressed portion 46 is formed in an upper end face 45*a* of the sensor fixation section 45. The cylinder section 51*b* of the stem 51 is inserted into the depressed portion 46. An internal threaded portion 46*a* (body side threaded portion) is formed on an inner peripheral surface of the depressed portion 46. An external threaded portion 51*d* (sensor side threaded portion) is formed on an outer peripheral surface of the cylinder section 51*b*. The fuel pressure sensor 50 is fixed to the injector body 4 by screwing the external threaded portion 51*d* of the stem 51 to the internal threaded portion 46*a* of the injector body 4.

A sensor side sealing surface 51*e* is formed on a cylinder end face of the cylinder section 51*b* around the inlet hole 51*a*. A body side sealing surface 46*b* is formed on a bottom face of the depressed portion 46. Both of the sealing surfaces 51*e*, 46*b* extend perpendicularly to an axial direction of the stem 51. Both of the sealing surfaces 51*e*, 46*b* extend in annular shapes around the inlet hole 51*a*.

The sensor side sealing surface 51*e* is pressed against the body side sealing surface 46*b* to achieve close contact therebetween, whereby metal touch sealing is achieved between the injector body 4 and the stem 51. A force (axial force) for pressing the sealing surfaces 51*e*, 46*b* against each other is caused by the thread connection of the stem 51 to the injector body 4. That is, the fixation of the stem 51 to the injector body 4 and the generation of the axial force are performed at the same time.

The strain gage 52 is fixed to the diaphragm section 51*c*. More specifically, the strain gage 52 is fixed by sealing (baking) the strain gage 52 with a glass member 52*b* in a state where the strain gage 52 is placed on the diaphragm section 51*c*. Thus, when the stem 51 elastically deforms to expand due to the pressure of the high-pressure fuel flowing into the cylinder section 51*b*, the strain gage 52 senses the magnitude of the strain (elastic deformation amount) caused in the diaphragm section 51*c*.

A metallic plate 53 in the shape of a disc is fixed to the stem 51. A mold IC 54 (explained later) is fixed and supported on the plate 53.

The mold IC 54 is electrically connected with the strain gage 52 via a wire bond W. The mold IC 54 is constructed by sealing an electronic component 54*a* and sensor terminals 54*b* with a molding resin 54*m*. The electronic component 54*a* provides an amplifier circuit that amplifies the sensing signal outputted from the strain gage 52, a filtering circuit that removes a noise superimposed on the sensing signal, a circuit that applies a voltage to the strain gage 52 and the like.

The strain gage 52, to which the voltage is applied by the voltage applying circuit, constitutes a bridge circuit, whose resistance changes in accordance with the magnitude of the strain caused in the diaphragm section 51*c*. Thus, an output voltage of the bridge circuit changes in accordance with the strain of the diaphragm section 51*c*. The output voltage is outputted to the amplifier circuit of the mold IC 54 as a pressure sensing value of the high-pressure fuel. The amplifier circuit amplifies the pressure sensing value outputted from the strain gage 52 (bridge circuit) and outputs the amplified signal from the sensor terminal 54*b*.

The molding resin 54*m* is formed in the shape of a cylinder extending annularly along an outer peripheral surface of the cylinder section 51*b* of the stem 51. The multiple sensor terminals 54*b* extend from an outer peripheral surface of the molding resin 54*m*. The sensor terminals 54*b* are electrically connected with the electronic component 54*a* inside the mold IC 54. The sensor terminals 54*b* function as a terminal for outputting the sensing signal of the fuel pressure sensor, a terminal for supplying a power, a terminal for grounding and the like.

A case 56 is fixed to an outer peripheral end portion of the plate 53. A portion of the cylinder section 51*b* of the stem 51 excluding the external threaded portion 51*d*, the strain gage 52 and the mold IC 54 are accommodated in a space defined by the case 56 and the plate 53. Thus, the case 56 and the plate 53 made of metal block out an external noise and protect the strain gage 52 and the mold IC 54. An opening 56*a* is formed in an outer peripheral surface of the case 56. The sensor terminals 54*b* extend from the inside to the outside of the case 56 through the opening 56*a*.

A housing 61 of the connector 60 holds the drive connector terminal 62 and sensor connector terminals 63. The sensor connector terminals 63 and the sensor terminals 54*b* are electrically connected by laser welding or the like via electrodes 71, 72, 73 (explained later). A connector of an external harness connected with external devices such as an engine ECU (not shown) is connected to the connector 60. Thus, the pressure sensing signal outputted from the mold IC 54 is inputted to the engine ECU through the external harness.

When the thread connection of the stem 51 to the injector body 4 is performed by rotating the stem 51, a rotational position of the stem 51 at a time point when the thread connection is completed is not settled in a specific position. This means that rotational positions of the sensor terminals 54*b* of the mold IC are also unspecified at the time point of the completion of the thread connection of the stem 51.

Therefore, the electrodes 72, 73, which are connected to the sensor terminals 54*b* respectively and which rotate together with the stem 51, respectively have annular connections 72*a*, 73*a*, each of which extends in an annular shape around the rotation central axis of the stem 51. The annular connections 72*a*, 73*a* are electrically connected with the multiple connector terminals 63 respectively after the thread connection of the stem 51 is completed. Thus, the sensor terminals 54*b*, whose rotational positions are unspecified, can be easily electrically connected with the connector terminals 63 arranged in specified positions of the injector body 4.

A connection 71*a* of the electrode 71 to be electrically connected with the connector terminal 63 is positioned at the rotation center of the stem 51. Therefore, the rotational position of the connection 71*a* is specified irrespective of the rotational position of the stem 51. The multiple electrodes 71, 72, 73 are molded with a molding resin 70*m* and are integrated. The multiple electrodes 71, 72, 73 are mounted on a top face of the case 56 in the molded state. Welded portions 63*a* protruding toward the connections 71*a*, 72*a*, 73*a* are formed on the connector terminals 63. A laser energy is concentrated on the welded portions 63*a* when the laser welding is performed.

As shown in FIG. 1, the lead wire 21 is connected to the electric actuator 2. The lead wire 21 is inserted and arranged in lead wire insertion holes 47*a*, 47*b* formed in the body 4 in a state where the lead wire 21 is held by holding members 21*a*, 21*b*. The holding members 21*a*, 21*b* are made of a material (resin such as nylon) having hardness lower than the metal in order to inhibit wearing of a cover of the lead wire 21. Shapes, thickness and the like of the holding members 21*a*, 21*b* are set such that rigidity of the holding members 21*a*, 21*b* is higher than the lead wire 21.

An outlet hole 47*c* is formed in an outer peripheral surface 45*b* of the sensor fixation section 45. The lead wire 21 extends from the lead wire insertion holes 47*a*, 47*b* to an outside of the body 4 via the outlet hole 47*c*. A portion of the lead wire 21 outside the outlet hole 47*c* is electrically connected with the drive connector terminal 62.

The lead wire insertion holes 47*a*, 47*b* include a first insertion hole 47*a* and a second insertion hole 47*b*. The first insertion hole 47*a* extends linearly along the central axis direction of the body 4. The second insertion hole 47*b* extends linearly from an upper end portion of the first insertion hole 47*a* toward the outlet hole 47*c* located in the outer peripheral surface 45*b* of the sensor fixation section 45. The first insertion hole 47*a* and the second insertion hole 47*b* are holes each having a round cross-section. The axial center of the first insertion hole 47*a* coincides with the axial center of the body 4. The axial center of the stem 51 coincides with the axial center of the body 4.

The holding members 21*a*, 21*b* consist of a holding member 21*a* arranged in the first insertion hole 47*a* and a holding member 21*b* arranged in the second insertion hole 47*b*.

Next, a procedure for fixing the fuel pressure sensor 50 and the like to the injector body 4 will be explained.

First, the plate 53, the mold IC 54, the case 56 and the molded electrodes 71, 72, 73 are assembled and integrated to the fuel pressure sensor 50 consisting of the stem 51 and the strain gage 52, thereby constructing a sensor assembly As. Then, the sensor assembly As is fixed to the injector body 4. More specifically, the external threaded portion 51*d* of the stem 51 is screwed to the internal threaded portion 46*a* formed in the depressed portion 46 of the injector body 4. Then, the electrodes 71, 72, 73 and the sensor connector terminals 63 are electrically connected by the laser welding or the like.

The electric actuator 2 is inserted into the accommodation hole 41 of the body 4, and the lead wire 21 of the electric actuator 2 is inserted into the lead wire insertion holes 47*a*, 47*b* from the accommodation hole 41 side in a state where the lead wire 21 is held by the holding members 21*a*, 21*b*. The portion of the lead wire 21 arranged outside the outlet hole 47*c* is electrically connected with the drive connector terminal 62 by the laser welding or the like.

Then, mold forming of the connector terminals 62, 63 and the sensor assembly As is performed with the molding resin while the connector terminals 62, 63 and the sensor assembly As are fixed to the injector body 4. The molding resin provides the connector housing 61. A portion of the lead wire 21, which is arranged outside the outlet hole 47*c* and which is welded with the connector terminal 62, and the fuel pressure sensor 50 is sealed together with the sensor fixation section 45 by using the molding resin. Thus, the fixation of the fuel pressure sensor 50 and the like to the injector body 4 and the internal electric connection are completed.

Next, positional relationships among the high-pressure passage 6, the low-pressure passage 7, the first insertion hole 47*a* and the second insertion hole 47*b* (lead wire insertion holes) formed in the injector body 4 will be explained with reference to FIGS. 3A to 3D. The high-pressure passage 6, the low-pressure passage 7, the first insertion hole 47*a* and the second insertion hole 47*b* (lead wire insertion holes) are formed by applying drilling process to the injector body 4.

FIGS. 3A to 3D show the single body of the injector body 4 according to the present embodiment. FIGS. 4A to 4D show a single body of a body 4*x* as a first comparative example studied by the inventors of the present invention. The first comparative example assumes a case where a fuel pressure sensor 50*x* is mounted to the body described in Patent document 1. Parts shown in FIGS. 4A to 4D corresponding to the parts shown in FIGS. 3A to 3D are denoted with reference numerals additionally having "x" in the ends. That is, for example, parts 4*x*, 6*x*, 7*x* shown in FIGS. 4A to 4D correspond to the parts 4, 6, 7 . . . shown in FIGS. 3A to 3D respectively.

Figure 3A:
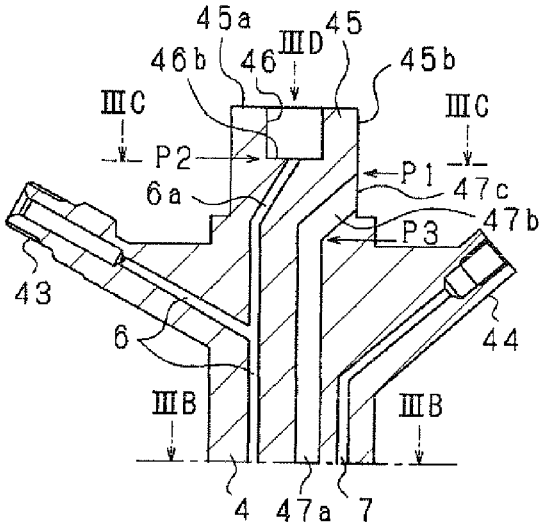
FIG. 3A is a longitudinal cross-sectional view showing a substantial part of a single body of the injector according to the first embodiment.

As shown in FIG. 3A, in the body 4 according to the present embodiment, the outlet hole 47*c* is formed in the outer peripheral surface 45*b* of the sensor fixation section 45 such that the outlet hole 47*c* is located below the depressed portion 46. More specifically, the uppermost portion P1 of the outlet hole 47*c* is located below the lowermost portion P2 of the depressed portion 46 (portion of body side sealing surface 46*b* in example of FIG. 3A). In the body 4 according to the present embodiment, the first insertion hole 47*a* is located below the depressed portion 46. More specifically, an end portion P3 of the first insertion hole 47*a* connecting with the second insertion hole 47*b* is located below the lowermost portion P2 of the depressed portion 46.

As a result, according to the present embodiment, the outlet hole 47*c* is located below the stem 51 (depressed portion 46). Thus, the second insertion hole 47*b*, which extends toward the outlet hole 47*c*, and the first insertion hole 47*a* are located below the mount space of the stem 51. Therefore, the lead wire insertion holes 47*a*, 47*b* and the depressed portion 46 (stem 51) can be prevented from abutting each other in the radial direction of the body 4 (refer to FIGS. 3B to 3D). Accordingly, a degree of freedom of mounting of the stem 51 can be improved while inhibiting increase of the radial size of the body 4.

Figure 4A:
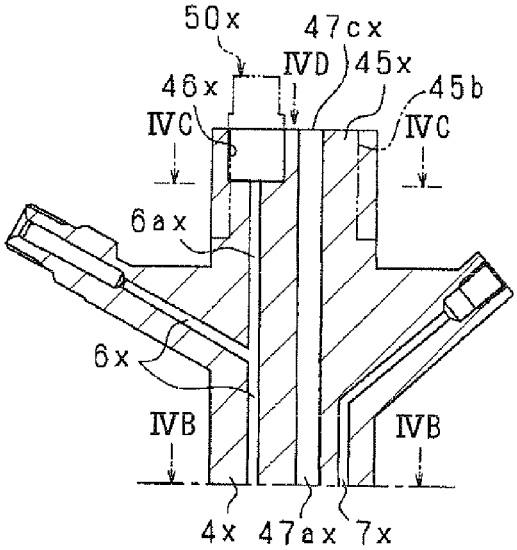
FIG. 4A is a longitudinal cross-sectional view showing a part of a single body of an injector of a first comparative example.
Figure 3B:
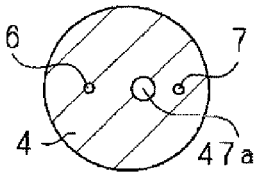
FIG. 3B is a cross-sectional view showing the injector of FIG. 3A taken along the line IIIB-IIIB.
Figure 4B:
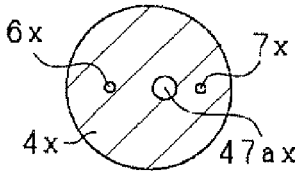
FIG. 4B is a cross-sectional view showing the injector of FIG. 4A taken along the line IVB-IVB.
Figure 3C:
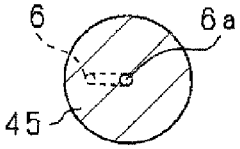
FIG. 3C is a cross-sectional view showing the injector of FIG. 3A taken along the line IIIC-IIIC.
Figure 4C:
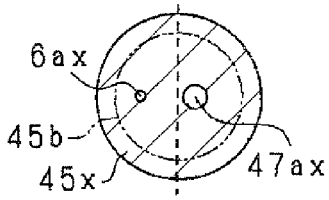
FIG. 4C is a cross-sectional view showing the injector of FIG. 4A taken along the line IVC-IVC.
Figure 3D:
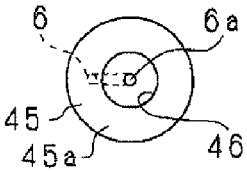
FIG. 3D is a view showing the injector of FIG. 3A along a direction of an arrow mark IIID.
Figure 4D:
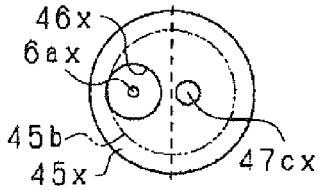
FIG. 4D is a view showing the injector of FIG. 4A along a direction of an arrow mark IVD.
Figure 5A:
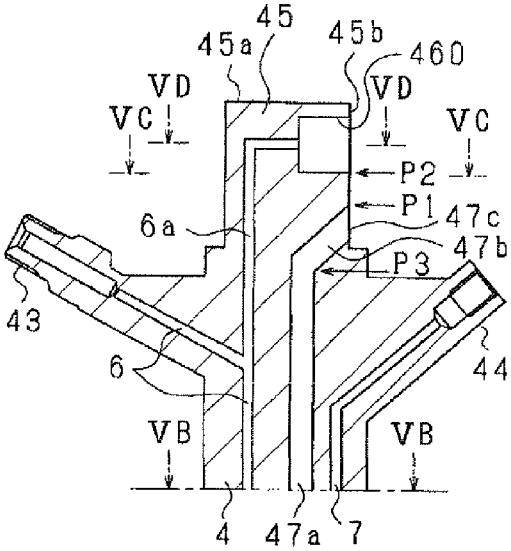
FIG. 5A is a longitudinal cross-sectional view showing a substantial part of a single body of an injector according to a second embodiment of the present invention.

As contrasted thereto, in the body 4*x* of the first comparative example shown in FIG. 4A, the lead wire insertion hole 47*ax* is formed in the shape extending along the direction of the central axis of the body 4*x*, and the outlet hole 47*cx* is formed in the upper end face of the sensor fixation section 45*x*. Therefore, the lead wire insertion hole 47*ax* and the depressed portion 46*x* align in the radial direction of the body 4*x* (refer to FIGS. 4B to 4D). Therefore, the depressed portion 46*x* cannot be formed in an area on a right side of a broken line in the cross-section of the body 4*x* shown in FIG. 4C or 4D. Therefore, a degree of freedom of mounting of the stem is restrained correspondingly. As a result, in order to ensure the mounting area of the depressed portion 46*x* only in an area on the left side of the broken line in the cross-section of the body 4*x* shown in FIG. 4C or 4D, it is required to increase the external diameter of the sensor fixation section 45*x*. A chain double-dashed line in FIG. 4C or 4D shows the outer peripheral surface 45*b* of the sensor fixation section 45 according to the present embodiment.

Furthermore, the present embodiment exerts following effects.

The resin molding of the portion of the lead wire 21 arranged outside the outlet hole 47*c* and the sensor assembly As is performed together with the sensor fixation section 45. Therefore, the portion of the lead wire 21 arranged outside the outlet hole 47*c* and the sensor assembly As can be easily fixed to the sensor fixation section 45 in an insulated state, which is preferable.

The sensor fixation section 45 to be molded with the resin is formed in the shape protruding upward further than the high-pressure port 43 and the low-pressure port 44. Therefore, the body size of the connector housing 61 can be reduced as compared to the case where the resin molding is performed together with parts of the both ports 43, 44. Eventually, the construction can contribute to the reduction of the body size of the injector. Since the sensor fixation section 45 is formed in the shape protruding upward, the space for arranging the stem 51 and the outlet hole 47*c* becomes a limited and small space. Therefore, the above-described effect of improving the degree of freedom of the mounting of the stem 51 while inhibiting the increase in the size of the body 4 can be exerted suitably.

The stem 51 is arranged above the engagement section 42 of the body 4. Therefore, the stem 51 is located in a position distanced from a portion of the body 4 where a large strain is caused (i.e., portion between portion held by cylinder head E2 and engagement section 42). Accordingly, an influence of the strain caused in the body 4 on the fuel pressure sensor can be suppressed, thereby improving the sensing accuracy of the fuel pressure.

The depressed portion 46 for inserting and arranging the stem 51 is formed to be depressed from the upper end face 45*a* of the sensor fixation section 45. Therefore, increase of the size of the sensor fixation section 45 can be inhibited as compared to the case where the sensor fixation section is formed in the shape extending in a cylindrical shape from the upper end face 45*a*. Since the stem 51 is fixed to the depressed portion 46 depressed from the sensor fixation section 45 in this way, the space for arranging the stem 51 becomes a limited and small space. Therefore, the above-described effect of improving the degree of freedom of the mounting of the stem 51 while inhibiting the increase in the size of the body 4 can be exerted suitably.

The sensor connector terminal 63 and the drive connector terminal 62 are supported by the common connector housing 61. Thus, the connector housing 61 and both of the terminals 62, 63 constitute the single connector. Therefore, the fuel pressure sensor 50 can be mounted in the injector without increasing the number of the connectors.

Second Embodiment

In the above-described first embodiment, the depressed portion 46 is formed in the upper end face 45*a* of the sensor fixation section 45, and the stem 51 is fixed from the upside of the sensor fixation section 45. In a second embodiment of the present invention shown in FIGS. 5A to 5D, a depressed portion 460 is formed in the outer peripheral surface 45*b* of the sensor fixation section 45, and the stem 51 is fixed along the radial direction of the sensor fixation section 45.

Also in the second embodiment, as in the first embodiment, the outlet hole 47*c* is located below the depressed portion 460. More specifically, the uppermost portion P1 of the outlet hole 47*c* is located below the lowermost portion P2 of the depressed portion 460. The first insertion hole 47*a* is located below the depressed portion 460. More specifically, a portion P3 that is an end portion of the first insertion hole 47*a* and that is connected to the second insertion hole 47*b* is located below the lowermost portion P2 of the depressed portion 460.

Figure 5B:
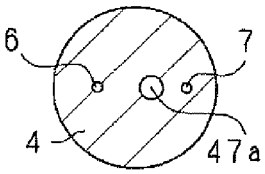
FIG. 5B is a cross-sectional view showing the injector of FIG. 5A taken along the line VB-VB.
Figure 5C:
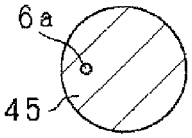
FIG. 5C is a cross-sectional view showing the injector of FIG. 5A taken along the line VC-VC.
Figure 5D:
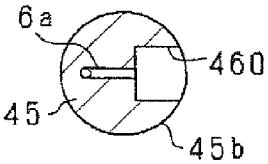
FIG. 5D is a cross-sectional view showing the injector of FIG. 5A taken along the line VD-VD.

Thus, also in the present embodiment, the lead wire insertion holes 47*a*, 47*b* and the stem 51 can be prevented from abutting each other in the radial direction of the body 4 (refer to FIGS. 5B to 5D). Accordingly, a degree of freedom of mounting of the stem 51 can be improved while inhibiting increase of the radial size of the body 4.

Figure 6A:
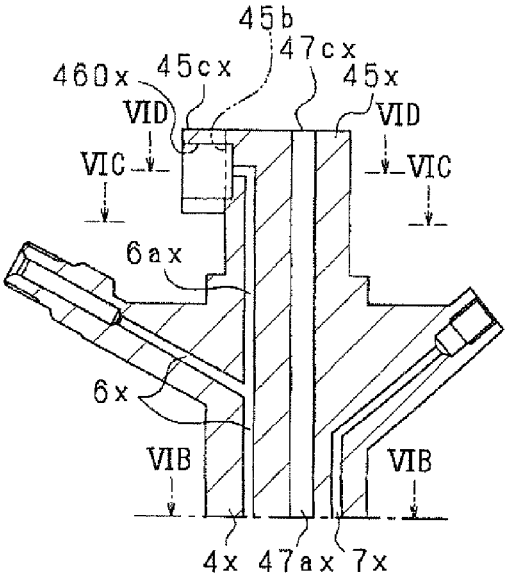
FIG. 6A is a longitudinal cross-sectional view showing a part of a single body of an injector of a second comparative example.
Figure 6B:
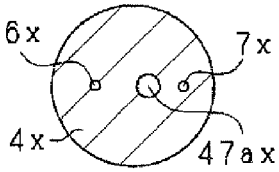
FIG. 6B is a cross-sectional view showing the injector of FIG. 6A taken along the line VIB-VIB.
Figure 6C:
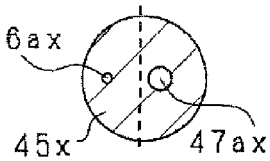
FIG. 6C is a cross-sectional view showing the injector of FIG. 6A taken along the line VIC-VIC.
Figure 6D:
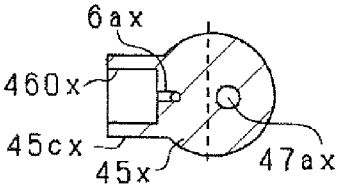
FIG. 6D is a cross-sectional view showing the injector of FIG. 6A taken along the line VID-VID.

As contrasted thereto, in a body 4*x* of a second comparative example shown in FIG. 6A, a lead wire insertion hole 47*ax* is formed in the shape extending vertically, and an outlet hole 47*cx* is formed in an upper end face of a sensor fixation section 45*x*. Therefore, the lead wire insertion hole 47*ax* and a depressed portion 460*x* align in the radial direction of the body 4*x* (refer to FIGS. 6B to 6D). The depressed portion 460*x* cannot be formed in an area on a right side of a broken line in the cross-section of the body 4*x* as shown in FIG. 6C or 6D. Therefore, a degree of freedom of mounting of the stem is restrained correspondingly. As a result, in order to secure the mounting area of the depressed portion 460*x* in an area on a left side of the broken line, it is required to form a projecting portion 45*cx* projecting in a cylindrical shape from the outer peripheral surface of the sensor fixation section 45*x* and to form the depressed portion 460*x* in the projecting portion 45*cx*. Therefore, the sensor fixation section 45*x* is enlarged in the radial direction.

Third Embodiment

Figure 7:
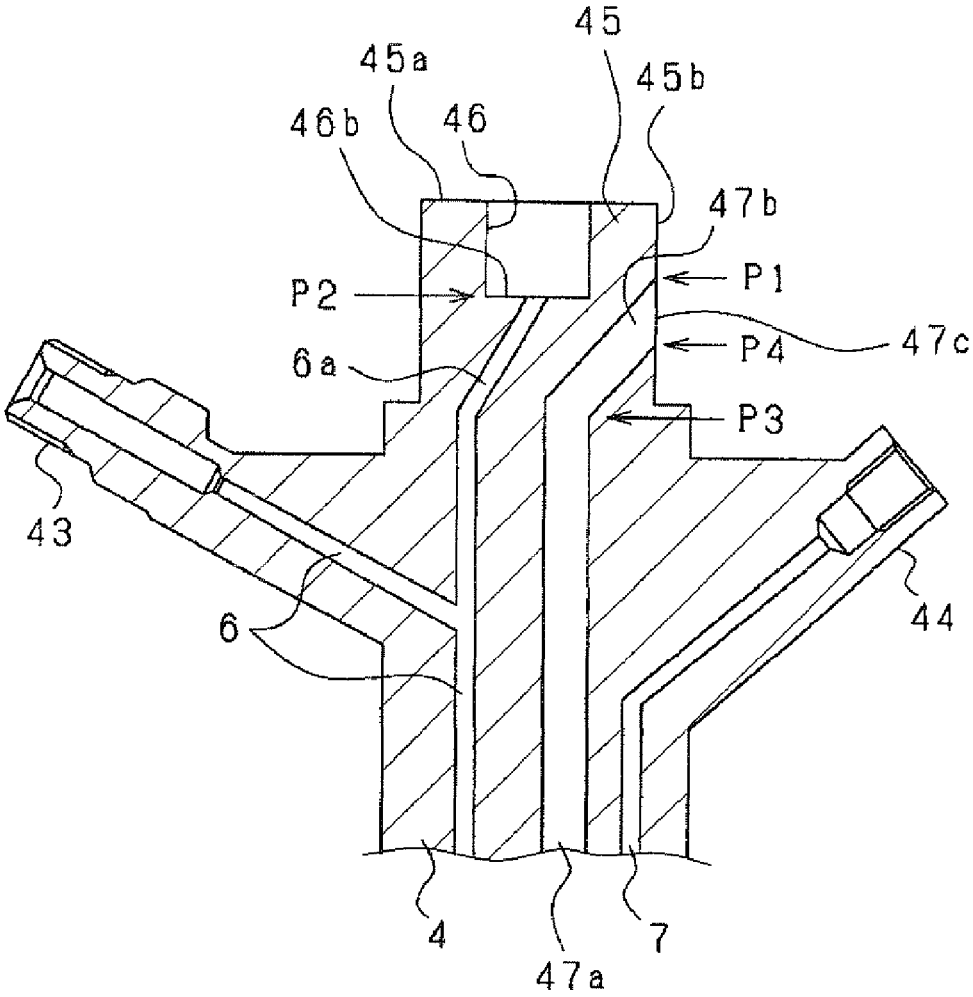
FIG. 7 is a longitudinal cross-sectional view showing a substantial part of a single body of an injector according to a third embodiment of the present invention.

In the above-described first embodiment, the uppermost portion P1 of the outlet hole 47*c* is located below the lowermost portion P2 of the depressed portion 46 (body side sealing surface 46*b*). In a third embodiment of the present invention shown in FIG. 7, the uppermost portion P1 of the outlet hole 47*c* is located above the lowermost portion P2 of the depressed portion 46, but the lowermost portion P4 of the outlet hole 47*c* is located below the lowermost portion P2 of the depressed portion 46.

A portion P3 that is an end portion of the first insertion hole 47*a* and that is connected to the second insertion hole 47*b* is located below the lowermost portion P2 of the depressed portion 46 as in the above-described first embodiment.

According to the present embodiment, although a part of the second insertion hole 47*b* abuts the depressed portion 46 in the radial direction of the body 4, abutment between the entire depressed portion 46 and the second insertion hole 47*b* in the axial direction can be avoided. Accordingly, a degree of freedom of mounting of the stem 51 can be improved while inhibiting increase of the radial size of the body 4 as compared to the first comparative example shown in FIGS. 4A to 4D.

Fourth Embodiment

In the above-described first embodiment, the present invention is applied to the injector that has the high-pressure port 43 in the outer peripheral surface of the body 4 and that receives the supply of the high-pressure fuel from the side of the body 4. The depressed portion 46 for inserting and arranging the stem 51 is formed in the upper end face 45*a* of the body 4 (sensor fixation section 45) to avoid the interference with the high-pressure port 43.

Figure 8:
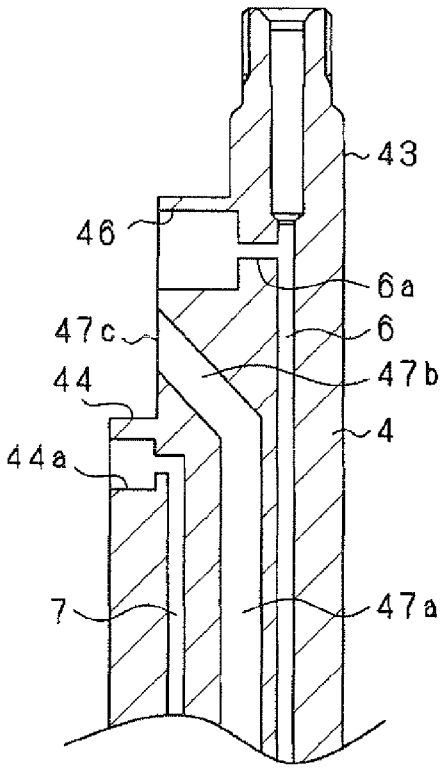
FIG. 8 is a longitudinal cross-sectional view showing a substantial part of a single body of an injector according to a fourth embodiment of the present invention.

In a fourth embodiment shown in FIG. 8, the present invention is applied to an injector that has a high-pressure port 43 in an upper end face of the body 4 and that receives the supply of the high-pressure fuel from an upside of the body 4. A depressed portion 46 for inserting and arranging the stem 51 is formed in an outer peripheral surface of the body 4 to avoid interference with the high-pressure port 43.

A high-pressure pipe (not shown) is fixed to an outer peripheral surface of the high-pressure port 43. A low-pressure pipe insertion hole 44*a* (low-pressure pipe connection) is formed in a low-pressure port 44. A low-pressure pipe (not shown) is inserted to the low-pressure pipe insertion hole 44*a*. The low-pressure pipe insertion hole 44*a* is provided below the outlet hole 47*c* in the outer peripheral surface of the body 4.

Also in the present embodiment, the outlet hole 47*c* is located below the depressed portion 46 like the above-described first embodiment. That is, the first insertion hole 47*a* is located below the depressed portion 46. Therefore, the lead wire insertion holes 47*a*, 47*b* and the depressed portion 46 can be prevented from abutting each other in the radial direction of the body 4. Accordingly, a degree of freedom of mounting of the stem 51 can be improved while inhibiting increase of the radial size of the body 4.

Fifth Embodiment

In the above-described fourth embodiment, the low-pressure pipe insertion hole 44*a*, the outlet hole 47*c* and the depressed portion 46 are arranged on the outer peripheral surface of the body 4. In such the construction, the outlet hole 47*c* is located below the depressed portion 46 and above the low-pressure pipe insertion hole 44*a*. Regarding this point, in a fifth embodiment of the present invention shown in FIG. 9, an outlet hole 47*c* is located below both of a depressed portion 46 and a low-pressure pipe insertion hole 44*a*.

With such the construction, the outlet hole 47*c* is located below the depressed portion 46 like the above-described fourth embodiment. Therefore, the lead wire insertion holes 47*a*, 47*b* and the depressed portion 46 can be prevented from abutting each other in the radial direction of the body 4. Accordingly, a degree of freedom of mounting of the stem 51 can be improved while inhibiting increase of the radial size of the body 4.

Moreover, in the present embodiment, the outlet hole 47*c* is located below the low-pressure pipe insertion hole 44*a*. Therefore, the lead wire insertion holes 47*a*, 47*b* and the low-pressure pipe insertion hole 44*a* can be prevented from abutting each other in the radial direction of the body 4. Accordingly, a degree of freedom of mounting of the stem 51 can be improved while inhibiting increase of the radial size of the body 4.

Figure 9:
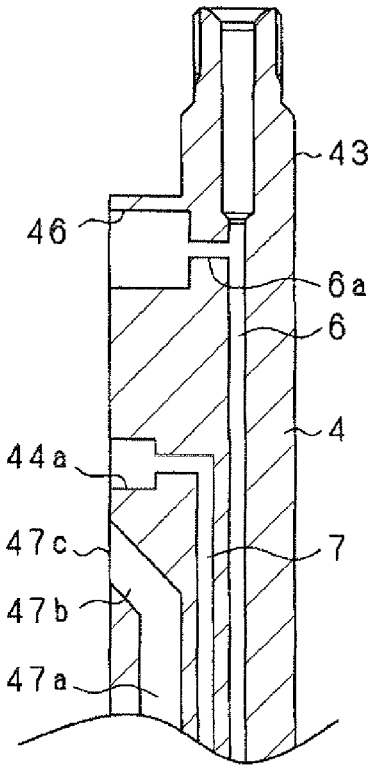
FIG. 9 is a longitudinal cross-sectional view showing a substantial part of a single body of an injector according to a fifth embodiment of the present invention.

Accordingly, the radial size of the body 4 of FIG. 9, in which the outlet hole 47*c* is located below the low-pressure pipe insertion hole 44*a*, can be reduced as compared to the body 4 of FIG. 8, in which the outlet hole 47*c* is located above the low-pressure pipe insertion hole 44*a*. However, in the body 4 of FIG. 8, the outlet hole 47*c* can be arranged near the depressed portion 46. Therefore, as compared to the body 4 of FIG. 9, the body 4 of FIG. 8 easily realizes a construction, in which the single connector is constructed by holding the sensor connector terminals 63 and the drive connector terminal 62 with the common connector housing 61.

Other Embodiments

The present invention is not limited to the above-described embodiments but may be modified and implemented as follows, for example. Further, characteristic constructions of the respective embodiments may be combined arbitrarily.

In the above-described first embodiment, assembling of the sensor assembly As to the injector body 4 and generation of the axial force between the sealing surfaces 51*e*, 46*b* are performed at the same time by screwing the stem 51. Alternatively, a threaded portion for assembling the sensor assembly As to the injector body 4 and a threaded portion for generating the axial force may be provided separately.

In the above-described embodiments, the threaded portion 51*d* is formed on the stem 51, and the stem 51 is screwed and connected to the body 4. Alternatively, a threaded portion may be formed on the plate 53 or the case 56 to perform thread connection of the plate 53 or the case 56 to the body 4, for example.

In the above-described embodiments, the strain gage 52 is used as the sensor element for sensing the strain amount of the stem 51. Alternatively, other sensor elements such as a piezoelectric element may be used.

In the above-described embodiments, the present invention is applied to the injector of the diesel engine. Alternatively, the present invention may be applied to a gasoline engine, and in particular, to a direct injection gasoline engine that injects the fuel directly into the combustion chamber E1.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An injector that is mounted in an internal combustion engine and that injects fuel from an injection hole, the injector comprising:

a body that defines a high-pressure passage for passing high-pressure fuel to the injection hole inside;

a needle that is accommodated in the body and that opens and closes the injection hole;

an electric actuator that causes the needle to perform the opening and closing action;

a lead wire that is arranged in a lead wire insertion hole formed in the body and that supplies an electric power to the electric actuator; and a fuel pressure sensor that is fixed to the body and that senses pressure of the high-pressure fuel, wherein the body is formed with an outlet hole, through which the lead wire extends from the lead wire insertion hole to an outside of the body, the outlet hole being located at a position closer to the injection hole than the fuel pressure sensor is.

2. The injector as in claim 1, wherein the body is formed in the shape of a substantially cylindrical column, a high-pressure port, to which the high-pressure fuel is supplied, and a low-pressure port, from which surplus fuel is discharged, are formed in an outer peripheral surface of the substantially cylindrical column shape of the body, a sensor fixation section is provided in an end portion of the substantially cylindrical column shape of the body such that the sensor fixation section protrudes further than the high-pressure port and the low-pressure port toward a side opposite from the injection hole, the fuel pressure sensor is fixed to the sensor fixation section and the outlet hole is formed in the sensor fixation section, and a portion of the lead wire arranged outside the outlet hole and the fuel pressure sensor are molded and sealed together with the sensor fixation section by using a resin.

3. The injector as in claim 2, wherein the body is inserted and arranged in a body insertion hole formed in a cylinder head of the internal combustion engine and is pressed against the body insertion hole by a clamp, the body has a pressed surface, which the clamp contacts to press the body, and the sensor fixation section is located on a side of the pressed surface opposite from the injection hole.

4. The injector as in claim 2, wherein the fuel pressure sensor has a strain element, which is fixed to the body and which elastically deforms in response to pressure of the high-pressure fuel, and a sensor element, which is fixed to the strain element and which converts magnitude of strain caused in the strain element into an electrical signal, the sensor fixation section is formed in the shape of a substantially cylindrical column and is formed with a depressed portion depressed from an outer peripheral surface or an end face of the substantially cylindrical column shape of the sensor fixation section, and the strain element is inserted and arranged in the depressed portion.

5. The injector as in claim 1, wherein the body is inserted and arranged in a body insertion hole formed in a cylinder head of the internal combustion engine and is pressed against the body insertion hole by a clamp, the body has a pressed surface, which the clamp contacts to press the body, a sensor fixation section is provided in an end portion of the body on a side opposite from the injection hole such that the sensor fixation section protrudes further than the pressed surface toward the side opposite from the injection hole, and the fuel pressure sensor is fixed to the sensor fixation section.

6. The injector as in claim 5, wherein the fuel pressure sensor has a strain element, which is fixed to the body and which elastically deforms in response to pressure of the high-pressure fuel, and a sensor element, which is fixed to the strain element and which converts magnitude of strain caused in the strain element into an electrical signal, the sensor fixation section is formed in the shape of a substantially cylindrical column and is formed with a depressed portion depressed from an outer peripheral surface or an end face of the substantially cylindrical column shape of the sensor fixation section, and the strain element is inserted and arranged in the depressed portion.

7. The injector as in claim 1, further comprising:

a connector housing that is fixed to the body and that is connected with an external harness through a connector;

a sensor connector terminal that is electrically connected with the fuel pressure sensor; and a drive connector terminal that is electrically connected with the lead wire, wherein the connector housing holds the sensor connector terminal and the drive connector terminal to provide the sensor connector terminal and the drive connector terminal in the common connector.

8. An injector that is mounted in an internal combustion engine and that injects fuel from an injection hole, the injector comprising:

a body that defines a high-pressure passage for passing high-pressure fuel to the injection hole inside;

a needle that is accommodated in the body and that opens and closes the injection hole;

an electric actuator that causes the needle to perform the opening and closing action;

a lead wire that is arranged in a lead wire insertion hole formed in the body and that supplies an electric power to the electric actuator; and a fuel pressure sensor that is fixed to the body and that senses pressure of the high-pressure fuel, wherein the body is formed in the shape of a substantially cylindrical column such that the injection hole is formed in a tip end of the body, the body is formed with an outlet hole, through which the lead wire extends from the lead wire insertion hole to an outside of the body, the outlet hole being formed in an outer peripheral surface of the body, the lead wire insertion hole has a first insertion hole that extends along a direction of a central axis of the substantially cylindrical column shape of the body and a second insertion hole that extends from an end portion of the first insertion hole toward the outlet hole, and the end portion of the first insertion hole is located at a position closer to the injection hole than the fuel pressure sensor is.

9. The injector as in claim 8, wherein a high-pressure port, to which the high-pressure fuel is supplied, and a low-pressure port, from which surplus fuel is discharged, are formed in an outer peripheral surface of the substantially cylindrical column shape of the body, a sensor fixation section is provided in an end portion of the substantially cylindrical column shape of the body such that the sensor fixation section protrudes further than the high-pressure port and the low-pressure port toward a side opposite from the injection hole, the fuel pressure sensor is fixed to the sensor fixation section and the outlet hole is formed in the sensor fixation section, and a portion of the lead wire arranged outside the outlet hole and the fuel pressure sensor are molded and sealed together with the sensor fixation section by using a resin.

10. The injector as in claim 9, wherein the body is inserted and arranged in a body insertion hole formed in a cylinder head of the internal combustion engine and is pressed against the body insertion hole by a clamp, the body has a pressed surface, which the clamp contacts to press the body, and the sensor fixation section is located on a side of the pressed surface opposite from the injection hole.

11. The injector as in claim 9, wherein the fuel pressure sensor has a strain element, which is fixed to the body and which elastically deforms in response to pressure of the high-pressure fuel, and a sensor element, which is fixed to the strain element and which converts magnitude of strain caused in the strain element into an electrical signal, the sensor fixation section is formed in the shape of a substantially cylindrical column and is formed with a depressed portion depressed from an outer peripheral surface or an end face of the substantially cylindrical column shape of the sensor fixation section, and the strain element is inserted and arranged in the depressed portion.

12. The injector as in claim 8, wherein the body is inserted and arranged in a body insertion hole formed in a cylinder head of the internal combustion engine and is pressed against the body insertion hole by a clamp, the body has a pressed surface, which the clamp contacts to press the body, a sensor fixation section is provided in an end portion of the body on a side opposite from the injection hole such that the sensor fixation section protrudes further than the pressed surface toward the side opposite from the injection hole, and the fuel pressure sensor is fixed to the sensor fixation section.

13. The injector as in claim 12, wherein the fuel pressure sensor has a strain element, which is fixed to the body and which elastically deforms in response to pressure of the high-pressure fuel, and a sensor element, which is fixed to the strain element and which converts magnitude of strain caused in the strain element into an electrical signal, the sensor fixation section is formed in the shape of a substantially cylindrical column and is formed with a depressed portion depressed from an outer peripheral surface or an end face of the substantially cylindrical column shape of the sensor fixation section, and the strain element is inserted and arranged in the depressed portion.

14. The injector as in claim 8, further comprising:

a connector housing that is fixed to the body and that is connected with an external harness through a connector;

a sensor connector terminal that is electrically connected with the fuel pressure sensor; and a drive connector terminal that is electrically connected with the lead wire, wherein the connector housing holds the sensor connector terminal and the drive connector terminal to provide the sensor connector terminal and the drive connector terminal in the common connector.

* * * * *